US005135162A

United States Patent [19]

Holzer

[11] Patent Number: 5,135,162

[45] Date of Patent: Aug. 4, 1992

[54] PROCESS AND EQUIPMENT DESIGNED TO CONTROL A BURNER FOR HEATING SYSTEMS

[76] Inventor: Walter Holzer, Drosteweg 19, D-7758 Meersburg, Fed. Rep. of Germany

[21] Appl. No.: 489,567

[22] Filed: Mar. 7, 1990

[30] Foreign Application Priority Data

Mar. 13, 1989 [DE] Fed. Rep. of Germany ..... 3908136

[51] Int. Cl.[5] ..... F23N 3/00

[52] U.S. Cl. ..... 236/46 F; 431/18

[58] Field of Search ..... 236/46 F, 46 E; 237/8 R; 307/117; 431/18, 73, 75

[56] References Cited

U.S. PATENT DOCUMENTS 4,196,356 4/1980 Kabat ..... 236/46 F

*Primary Examiner*—Henry A. Bennet

*Attorney, Agent, or Firm*—Browdy and Neimark

[57] ABSTRACT

Apparatus for controlling a heat generating device having automatic adjustment of water temperature to heating requirements, and also for protecting such devices from being switched "on" and "off" too frequently, includes a control relay or a main relay having a "pause" imprint contact for switching "off" and an "on" contact, as well as a chronometric device for measuring how long the heat generating device is switched "on" and for setting an "off" pause imprint interval which is inversely variable according to the measured length of time the heat generating device is switched "on".

18 Claims, 4 Drawing Sheets

PROCESS AND EQUIPMENT DESIGNED TO CONTROL A BURNER FOR HEATING SYSTEMS

FIELD OF THE INVENTION

BACKGROUND OF THE INVENTION

Frequent brief activation of the burner of a heating system as a result of low heating requirements at warmer times of the year results not only in the burner sustaining considerable wear and tear, but also in severe soiling of the nozzles and other parts of the burner.

Above all, however, each start-up gives rise to an extremely high emission of harmful substances which can reach levels over 1000 times higher than normal.

SUMMARY OF THE INVENTION

The task of the new process is to reduce the number of starts and so protect the burner and render the system more environmentally friendly.

DETAILED DESCRIPTION

According to the invention it is suggested that, depending on the length of time for which the burner is in operation, a pause be made to occur until the next start-up by opening a pause contact, the actual length of time for which the burner is in operation being measured by a chronometric device and the pause interval being set in inverse proportion to this length of time. The result is that where the length of operation is short and heating requirements are correspondingly low the pause interval set is longer, whilst in the event of the burner being in operation for a longer period of time and of heating requirements being correspondingly higher the pause is made shorter.

Such an inversely variable pause interval can be achieved simply by programming a maximum pause interval which is shortened by a constant multiple of the length of time for which the burner is in operation. Where the burner is in operation for greater lengths of time this will even cause the pause interval to be reduced to "0", thus enabling the full heating performance of the burner to be used.

According to the invention, in the case of multi-stage or adjustable burner systems it is suggested that the burner output be controlled in a variable manner.

This can, for example, be accomplished according to the invention by one or a number of pre-settable lengths of operating time being programmable in the control system such that when these lengths of time are exceeded the burner is turned down to a lower level.

Only when the pause interval drops to '0' does the burner receive the command to return to a higher level of output.

Depending on the size and situation of the rooms it may make sense to make the maximum pause interval and/or the multiplication constant adjustable in order to obtain optimum conditions.

To make it possible to intervene in the control program in extreme situations, for example when giving rooms an airing during winter, it is recommended that there should be a bridging contact to the pause contact.

This bridging contact may also be a thermostat which closes when the temperature falls below a given minimum threshold such as 16° C.

The following presents a simple example of a control system according to the invention which describes the idea of the invention in schematic form. This example is not to be regarded as restrictive. On the contrary, because the possibilities now available using microprocessors mean that even programs involving complex calculations can be used to determine the pause intervals, equivalent solutions of any kind can be designed as desired. The essential point is still determining the required amount of heat from the ratio of the length of time during which burning is in progress and/or of the pause.

Figure 1:
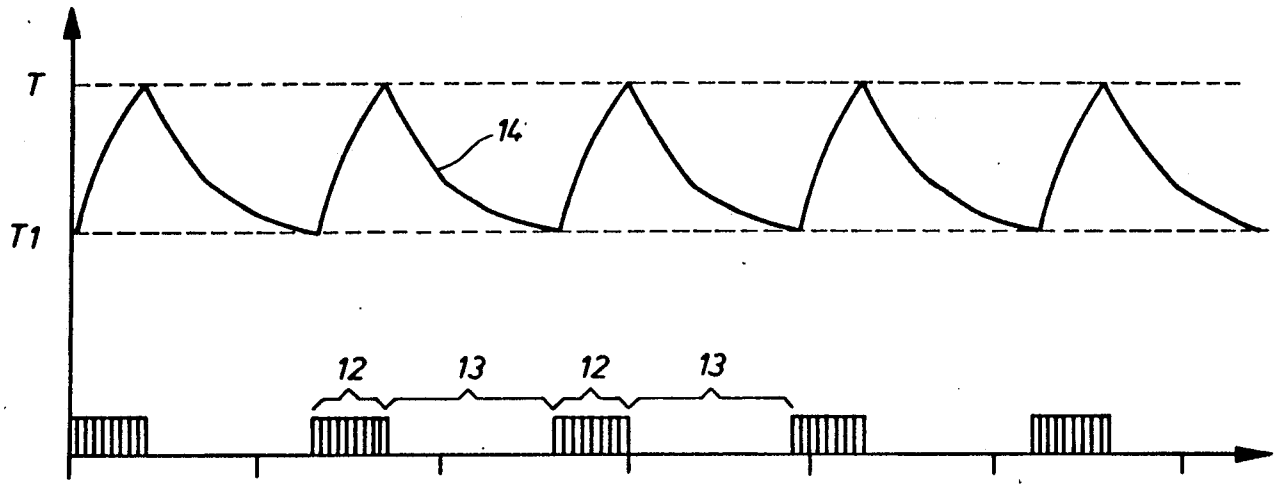
FIG. 1 shows on-off cycles of the prior art.

FIG. 1 shows the action chart of a previous temperature control system between two fixed temperatures $T_1$ and T. As soon as the room temperature drops below the value $T_1$, the burner and/or the heating system is switched on until the temperature T is reached. The thermostat then switches it off and so on and so on.

From this is derived the temperature progression (14). The blocks shown in FIG. 1 show the operating status of the burner at any given time. Other conditions being constant, the result is roughly equal operating times (12) and pause intervals (13).

During warm weather, i.e. when heating requirements are low and water circulation is reduced the switching intervals can be very brief and frequent.

Figure 2:
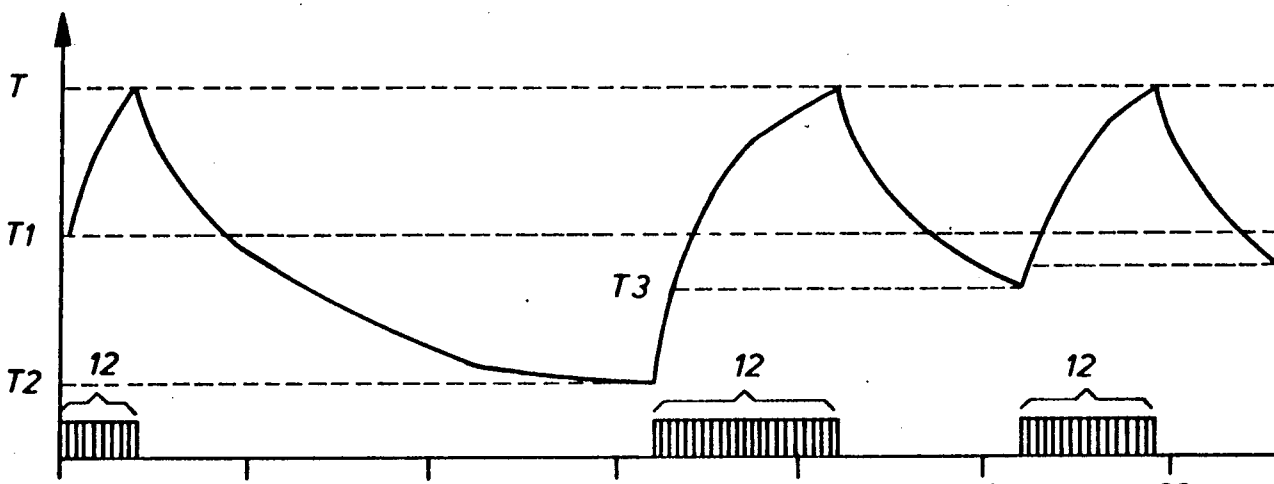
FIG. 2 shows on-off cycles in accordance with the invention.

FIG. 2 is an equivalent action chart for an installation according to the invention.

Figure 3:
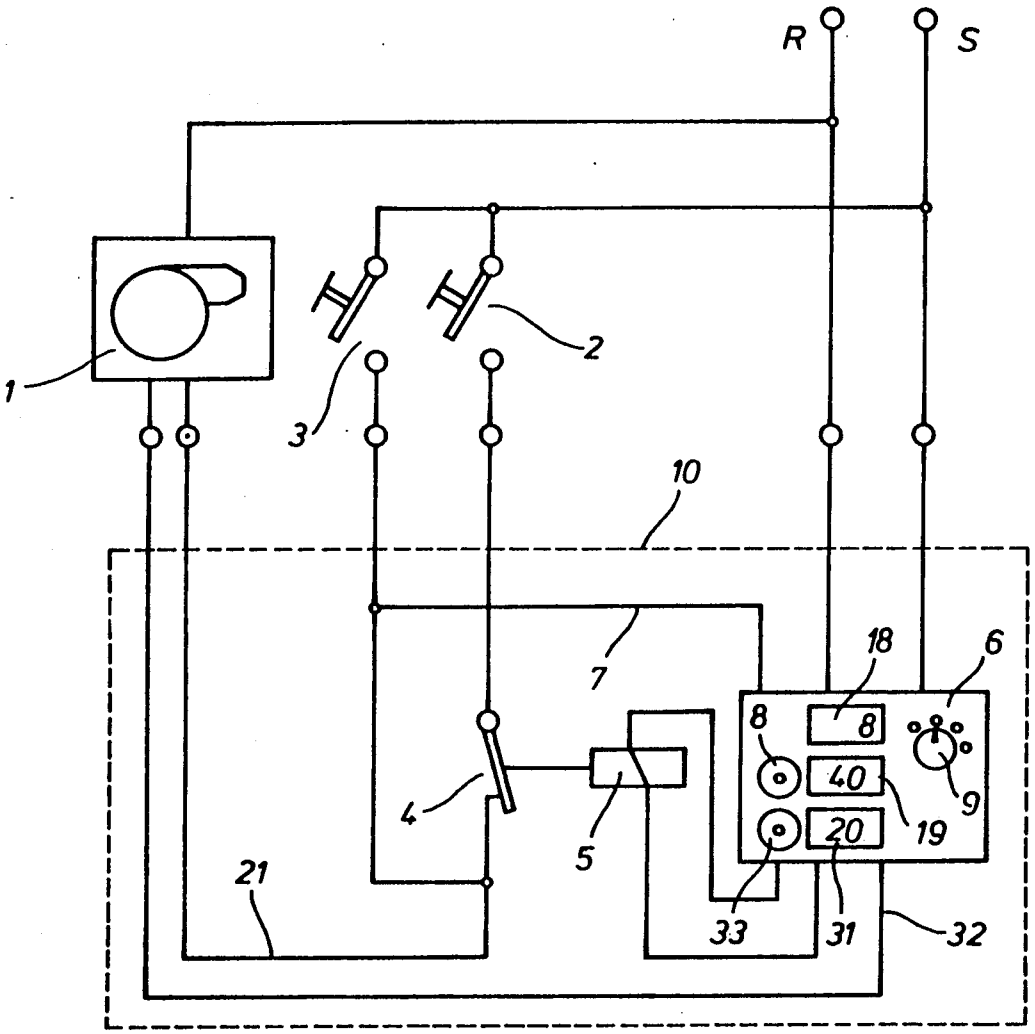
FIG. 3 shows a control circuit in accordance with this invention.

FIG. 3 shows the outline circuit diagram of a pause control system according to the invention.

The burner (1) is switched on by the thermostat contact (2) via the normally closed pause contact (4). At the same time the timing control (6) is informed via the wire (7) that the burner (1) is in operation.

As soon as the thermostat contact (2) re-opens, control (6) of the measurement of how long the burner (1) has been switched on for, ends. At the same time, the timing control (6) operates the pause contact (4) via the relay (5), opens the pause contact (4), thereby blocking the re-activation of the burner (1).

The timing control (6) can for example work according to the formula:

$$T_p = PM - (K+1) \times t_{Br}$$

where:

$T_p$ = Pause interval

Pm = Max. pause interval

K = Multiplication constant $T_{Br}$ = Length of time burner is in operation

Figure 4:
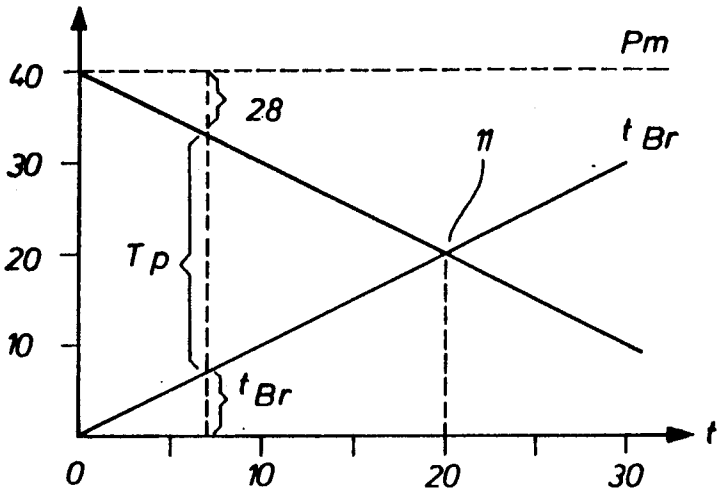
FIG. 4 shows the progression of burner operating time.

This function can be seen from FIG. 4, in which the horizontal axis shows the time t in minutes and the vertical axis shows the pause interval $T_p$, also in minutes.

FIG. 4 shows the progression of the operating time of the burner and, derived from this, the pause interval $T_p$. In the example in FIG. 4 it is assumed that the maximum pause interval Pm amounts to forty minutes and that the multiplication constant K is equal to 1, in other words for every minute during which the burner is in operation the pause is also reduced by one minute. This means that for every minute during which burning is in progress, one minute of reduction in the pause interval is deducted from the maximum pause interval (cycle time) in addition to the length of time during which burning is in progress.

The point (11) in FIG. 4 at the intersection of the straight lines $T_p$ and $T_{Br}$ means that in this example after twenty minutes of burning the pause interval $T_p$ has shrunk to '0'.

Figure 6:
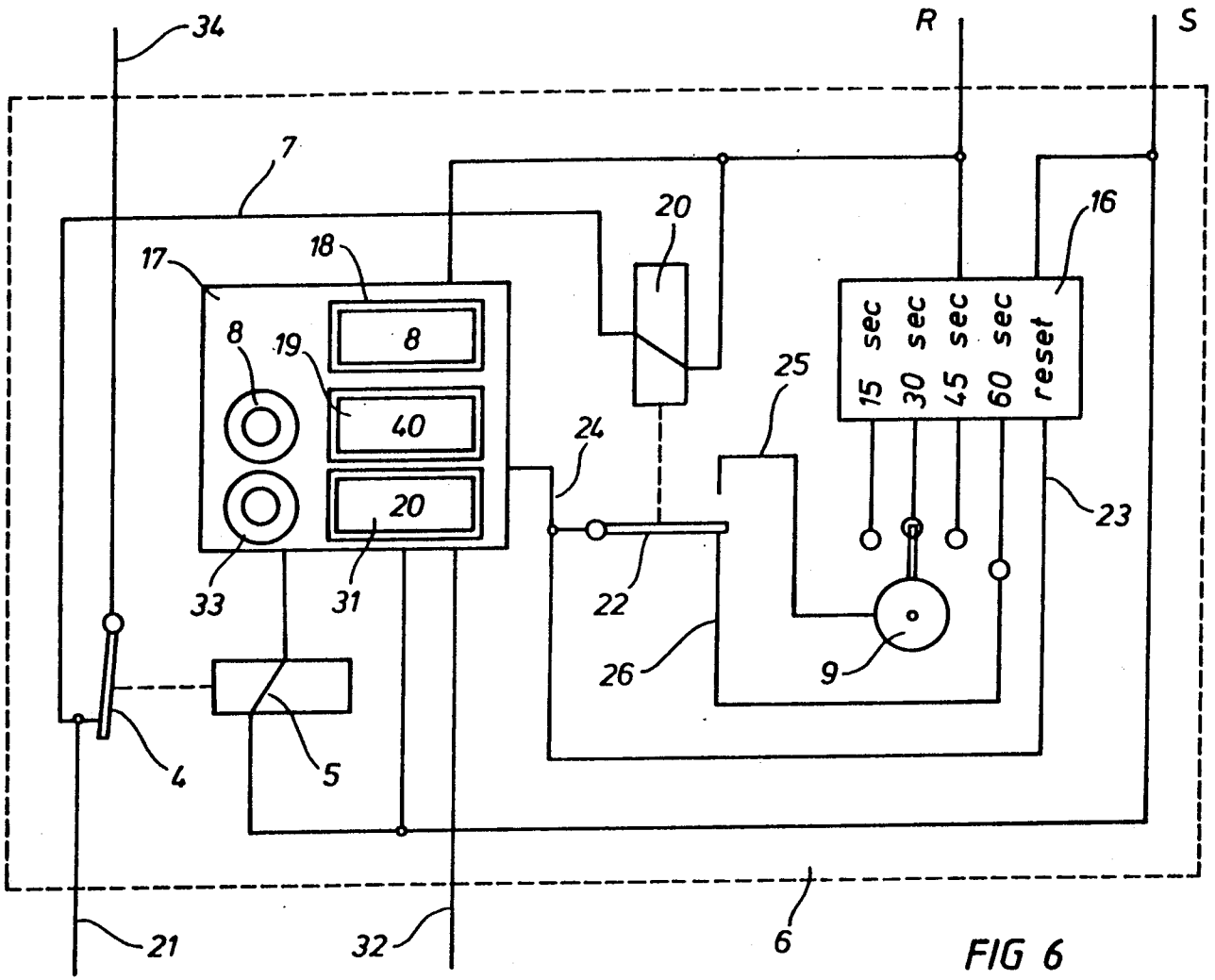
FIG. 6 shows a digital timing control embodiment.

FIG. 6 shows in schematic form the structure of a digital timing control capable of performing the pause switching shown in FIG. 1.

Such a timing control may for example consist of a digital pulse generator (16) and a pulse counter (17).

The pulse generator (16) is, for example, designed in such a way that it is possible to opt for the timing pulse to be picked up and fed to the pulse counter (17) after 60, 45, 30 or 15 seconds. After the maximum time of 60 seconds has elapsed, the pulse generator (16) is re-set to '0'.

Where a shortened pulse interval is set by selecting the switch (9), the re-setting of the pulse generator (16) is brought forward by means of the re-set wire (23).

On the pulse counter (17), the adjustment button (8) is used to adjust the maximum number of pulses at which the pauses can be terminated and the burner reactivated by the thermostat (2). At the same time, the number of maximum pulses can be read off from the display (19).

A second display (18) can, if desired, also show the current number of pulses which have elapsed in the cycle currently in progress.

As soon as the thermostat (2) switches on, the relay (20) also receives power via the wire (7) and switches the contact (22), the task of which is to switch over the clock times, to the wire (25) and thus via the selection switch (9) to one of the reduced clock times, such as the 30 second clock time shown in the diagram for example, this being twice as fast as the basic clock time of 60 seconds.

If, upon reaching the upper temperature T, the thermostat (2) now switches off, the relay (20) then loses its power supply. It cuts out and the contact (22) connects the pulse counter (17) to the basic clock time of 60 seconds via the wires (24) and (26). At the same time the relay (5) cuts in and opens the pause contact (4).

As a consequence the pulse generator (16) sends pulses to the pulse counter (17) every 60 seconds until the number of pulses indicated on the display (19) ('40' in this case) is attained. At this maximum number of pulses the pulse counter (17) is re-set to '0', the relay (5) loses its power supply and the pause contact (4) closes.

Only now can the burner (1) resume operation even if the thermostat (2) had closed beforehand.

If the contact (2) is not yet closed, the entire timing control (6) remains on stand-by until the relay (20) has its power supply restored the next time the thermostat switches on (2).

Figure 5:
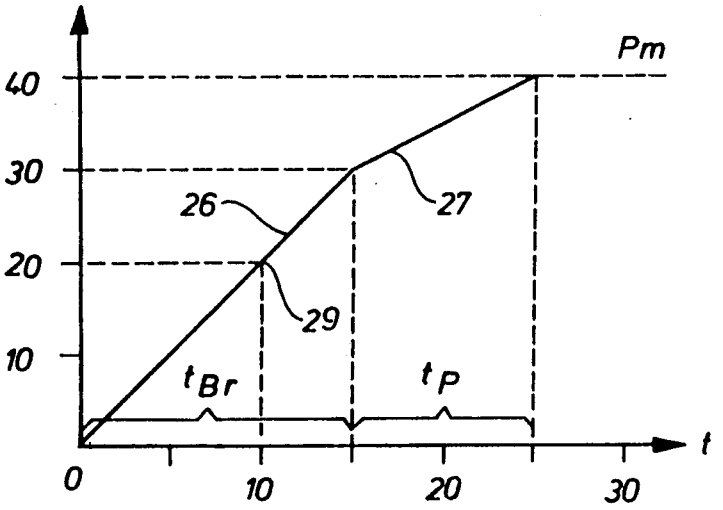
FIG. 5 shows the progression of a normal curve obtained with the circuit of FIG. 6.

FIG. 5 shows the progression of a normal curve such as can be obtained with the circuit in FIG. 6.

Again, the horizontal axis represents the time t and the vertical axis represents the number of the corresponding timing pulses. This example too assumes a pre-selected maximum of 40 pulses. The multiplication constant K=1 also remains the same. This corresponds to a pulse sequence which is twice as fast whilst the burner is in operation, i.e. 1 pulse every 30 seconds.

Accordingly, for the time during which the burner is running, assumed to be 15 minutes, FIG. 5 shows a steep rise in this time up to 30 pulses corresponding to line 26. As soon as the burner is switched off, for the rest of the time (pause interval $T_p$) the time is counted slowly at one pulse per minute in accordance with line 27 until the pre-selected maximum pause interval $P_m$ is finally reached at 40 pulses.

This corresponds exactly to the specified formula:

$$T_p = Pm - (K+1) \times t_{BR}$$

FIG. 5 also shows how a two-stage burner could, for example, be run with adjustable output, e.g., at full or half power.

According to the invention there is a further possibility whereby the pulse counter (17) of the timing control (6) can be adjusted. By means of the button (33) it is possible to set the number of pulses (31) at which the control unit checks whether the burner is still switched on, corresponding to Point 29 in FIG. 5. If it is not, this means that less than half of the burner's output is needed in the control cycle and the timing control system (6) sends a command via the command wire (32) to switch over to half power. See circuit diagram in FIG. 6.

Conversely, if, upon reaching the pre-determined maximum number of pulses, it finds that the burner is still switched on, this means that the remaining pause interval is "0". The burner is therefore given the command via the command wire (32) to run at higher power.

The button (33) can be used to adapt the number of pulses (31) to varying conditions, for example in order to check whether the burner should be switched over at half the number of pulses in the cycle or only at ¾ of the maximum pulses in the cycle.

The example described is intended to impart a better understanding of the invention but both the time measurement and the evaluation in the "cycle" can be varied at will, as long as such means can be used to solve the problem in hand according to the invention.

I claim:

1. Equipment for controlling a heat generating device having automatic adjustment of water temperature to heating requirements, and for protecting said device from being switched "on" and "off" too frequently, comprising:

a control relay or main relay having a "pause" imprint contact for switching "off" and an "on" contact, and a chronometric device for measuring how long the device is switched "on" and for setting an "off" pause imprint interval which is inversely variable according to the measured length of time the device is switched "on".

2. Equipment as claimed in claim 1 wherein a maximum pause interval is pre-programmed which is shortened by a constant multiple of the length of time for which the burner has been switched on.

3. Equipment as claimed in claim 1 wherein in cases involving multi-stage or adjustable burner systems, the pause interval and/or the burner output is variable depending on the length of time for which the burner has been switched on.

4. Equipment as claimed in claim 3 wherein the burner can be pre-set to operate for one or a number of lengths of time, such that the burner is turned down as soon as these are exceeded.

5. Equipment as claimed in claim 4 wherein upon reaching a pause interval of "0", the burner is turned up to a higher level of output.

6. Equipment as claimed in claim 2 wherein the maximum pause interval and/or the constant multiple can be adjusted.

7. Equipment as claimed in claim 6 wherein the maximum pause interval and/or the constant multiple are variable depending on the time of day or on the temperature.

8. Equipment as claimed in claim 1, further comprising that there is a bridging contact to the pause contact.

9. Equipment as claimed in claim 8 wherein the bridging contact is controlled by a thermostat and/or timer.

10. A method for controlling a heat generating device having automatic adjustment of water temperature to heating requirements and for protecting said device from being switched "on" and "off" too frequently, comprising the steps of:

controlling a relay or main relay having an "off" (pause) imprint upon contact and an "on" contact;

measuring with a chronometric device how long the heat generating device is switched "on"; and setting an "off" (pause) imprint interval which is inversely variable according to the measured length of time the device is switched "on".

11. A method as claimed in claim 10 wherein a maximum pause interval is pre-programmed which is shortened by a constant multiple of the length of time for which the burner has been switched on.

12. A method as claimed in claim 10 wherein, in cases involving multi-stage or adjustable burner systems, the pause interval and/or the burner output is varied depending on the length of time for which the burner has been switched on.

13. A method as claimed in claim 12 wherein the burner pre-set to operate for one or a number of lengths of time, such that the burner is turned down as soon as these are exceeded.

14. A method as claimed in claim 13 wherein upon reaching a pause interval of "0", the burner is turned up to a higher level of output.

15. A method as claimed in claim 11 wherein the maximum pause interval and/or the constant adjusted.

16. A method as claimed in claim 15 wherein the maximum pause interval and/or the constant multiple are varied depending on the time of day or on the temperature.

17. A method as claimed in claim 10 further comprising effecting a bridging contact to the pause contact.

18. A method as claimed in claim 17 comprising effecting the bridging contact by a thermostat and/or timer.

* * * * *